United States Patent [19]

Richards

[11] 4,133,393

[45] Jan. 9, 1979

[54] DOWN-THE-HOLE PERCUSSION DRILLS

[75] Inventor: Ernest J. Richards, Redruth, England

[73] Assignee: Compair Construction and Mining Limited, Camborne, England

[21] Appl. No.: 818,760

[22] Filed: Jul. 25, 1977

[30] Foreign Application Priority Data

Jul. 28, 1976 [GB] United Kingdom ..... 31475/76

[51] Int. Cl.[2] ..... B25D 17/14

[52] U.S. Cl. ..... 173/64; 173/17; 173/66; 173/73

[58] Field of Search ..... 91/232, 325; 173/17, 173/64, 66, 67, 73, 77, 78, 80, 137

[56] References Cited

U.S. PATENT DOCUMENTS

| | | | |
|---|---|---|---|
| 3,084,673 | 4/1963 | Sears | 173/17 |
| 3,193,024 | 7/1965 | Cleary | 173/64 X |
| 3,195,657 | 7/1965 | Collier | 173/73 X |
| 3,225,841 | 12/1965 | Thompson | 173/73 X |
| 3,229,776 | 1/1966 | Collier | 173/17 |
| 3,311,177 | 3/1967 | Collier et al. | 173/80 X |
| 3,361,219 | 1/1968 | Sears | 173/64 |
| 3,527,239 | 9/1970 | Boom | 173/17 X |
| 3,583,501 | 6/1971 | Aalund | 173/80 X |
| 3,924,690 | 12/1975 | Shaw | 173/80 X |
| 3,970,153 | 7/1976 | Gien et al. | 173/17 |

FOREIGN PATENT DOCUMENTS

| | | | |
|---|---|---|---|
| 188587 | 4/1964 | Sweden | 173/137 |

*Primary Examiner*—Lawrence J. Staab

*Attorney, Agent, or Firm*—Watson, Cole, Grindle & Watson

[57] ABSTRACT

A down-the-hole pneumatic drill in which the reciprocating hammer-piston slides over a ported tubular structure mounted centrally in the cylinder of the drill body and providing two longitudinal passages through which passes all the pressure air required below the piston. The tubular structure comprises an outer tube having a close-fitting inner tube within it, the inner tube being formed in its wall with a longitudinal indentation closed at the lower end, one of the passages being defined by the indentation and the wall of the outer tube and the other passage being defined by the interior of the inner tube. The tubular structure is provided with ports controlled by the sliding hammer-piston, certain of these ports being formed by registering holes in portions of the walls of the inner and outer tubes which lie in contact with one another. The drill has a pressure-responsive disc valve at its upper end by which pressure air is distributed alternately into the upper working chamber of the cylinder and, via the indentation, into the lower working chamber to effect respectively the downward power stroke and the return stroke of the piston, the air being exhausted at the end of each stroke through the tubular structure to an exhaust passage at the lower end of the drill body.

7 Claims, 7 Drawing Figures

DOWN-THE-HOLE PERCUSSION DRILLS

BACKGROUND AND OBJECTS OF THE INVENTION

This invention relates to fluid-pressure-operated percussion drills of the kind known as "down-the-hole" drills, in which a tubular drill body containing a percussive hammer piston and the cylinder in which it reciprocates is passed down the hole being drilled together with the drilling bit carried by the drill body, instead of remaining above ground level. The rotation of the drill bit is obtained by rotating the whole drill, on the end of the string of tubes on which the drill body is mounted, by means of a rotary motor which remains outside the hole.

In down-the-hole drills it is usual to deliver the used working fluid exhausted from the working chambers above and below the piston to the drill bit, where it passes around the cutting edges of the bit so as to flush away rock chippings. Thus it is necessary to provide passages in the drill body to carry the pressure fluid, usually compressed air, past the hammer piston to the lower working chamber for lifting the piston, and to carry the exhaust fluid from the upper and lower chambers to the drill bit for flushing. To avoid increasing the diameter of the drill body for this purpose, it has been proposed to provide a central tube extending longitudinally through a central axial bore in the hammer piston, which slides up and down this tube in the cylinder when reciprocating, the tube carrying fluid down past the piston for exhaustion to the bit.

An object of the present invention is to provide a down-the-hole drill having a central axial tubular structure of simple construction which is utilised to carry all the pressure fluid required below the hammer piston, thereby obviating the need for any further passages either in the drill body or in the hammer for this purpose.

BRIEF SUMMARY OF THE INVENTION

According to the present invention, a down-the-hole fluid-pressure-operated drill comprises a drill body affording an internal cylinder in which a hammer piston reciprocates, upper and lower working chambers at opposite ends of the cylinder into which the working fluid is delivered cyclically, valve means arranged to deliver the pressurised working fluid from an inlet on the upper end of the drill body alternately to the upper and lower working chambers for effecting respectively the power stroke and the return stroke of the hammer piston in the cylinder, and means for mounting an anvil associated with the drill bit in the lower end of the drill body, against which anvil the hammer piston impacts at the end of each power stroke, there being an exhaust passage situated at the lower end of the drill body, for example through the anvil, for the delivery of exhaust fluid from the working chambers to the exterior of the drill body through or in the vicinity of the drill bit for flushing purposes, and in which the hammer piston slides on a ported tubular structure and cooperates with longitudinally-spaced ports in the latter, the tubular structure extending lengthwise in the cylinder through a central bore in the hammer piston and having at least two longitudinal passages which carry the working fluid, the longitudinally-extending passages extending side by side or one within the other, and including or comprising a first passage which carries pressurised working fluid from the valve means directly into the lower working compartment for effecting the return stroke of the hammer piston, and a second passage which communicates with the exhaust passage and carries exhaust fluid thereto from the upper working compartment at the end of the power stroke and from the lower working compartment at the end of the return stroke.

Preferably the valve means is situated above the tubular structure, and means is provided for passing pressurised working fluid from the valve means directly into the upper working chamber outside the tubular structure for effecting the power stroke.

In one form of the invention, the tubular structure comprises an outer tube with an inner tube extending within its interior, one or more of the longitudinal passages being defined between radially-spaced portions of the walls of the inner and outer tubes.

In one such arrangement, in which the inner and outer tubes are a close fit one within the other, and are joined together at both ends, at least one of the longitudinal passages is formed by a longitudinal indentation formed in a part of the wall of the inner tube, the remainder of the circumference of which wall part lies against the inner surface of the wall of the outer tube.

Some or all of the ports of the tubular structure may be formed by registering apertures in portions of the walls of the inner and outer tubes which lie in contact with one another.

The indentation in the inner tube wall may terminate at its lower end short of the corresponding end of the inner tube to close that end of the respective longitudinal passage.

There may be two and only two longitudinal passages in the tubular structure, namely the said first passage which is formed by the indentation in the wall of the inner tube, and the said second passage which is formed by the interior of the inner tube, and means may be provided for passing pressurised working fluid from the valve means outside the tubular structure and thence directly into the upper working chamber for effecting the power stroke.

The anvil may be arranged to slide telescopically in the drill body and on the lower end of the tubular structure, the exhaust passage being formed in the anvil in direct communication with the second longitudinal passage of tubular structure.

The distribution valve may be of pressure responsive disc type, housed in the upper end of the drill body.

To provide an uninterrupted supply of the pressure fluid to the exhaust passage in the vicinity of the drill bit for "supplementary blowing", the tubular structure may include an extension of the second passage at its upper end, into communication with the pressure fluid inlet, by passing the distribution valve means.

DESCRIPTION OF THE DRAWINGS

The invention may be carried into practice in various ways, but one specific embodiment and two modifications thereof will now be described by way of example and with reference to the accompanying drawings, in which.

Figure 1:
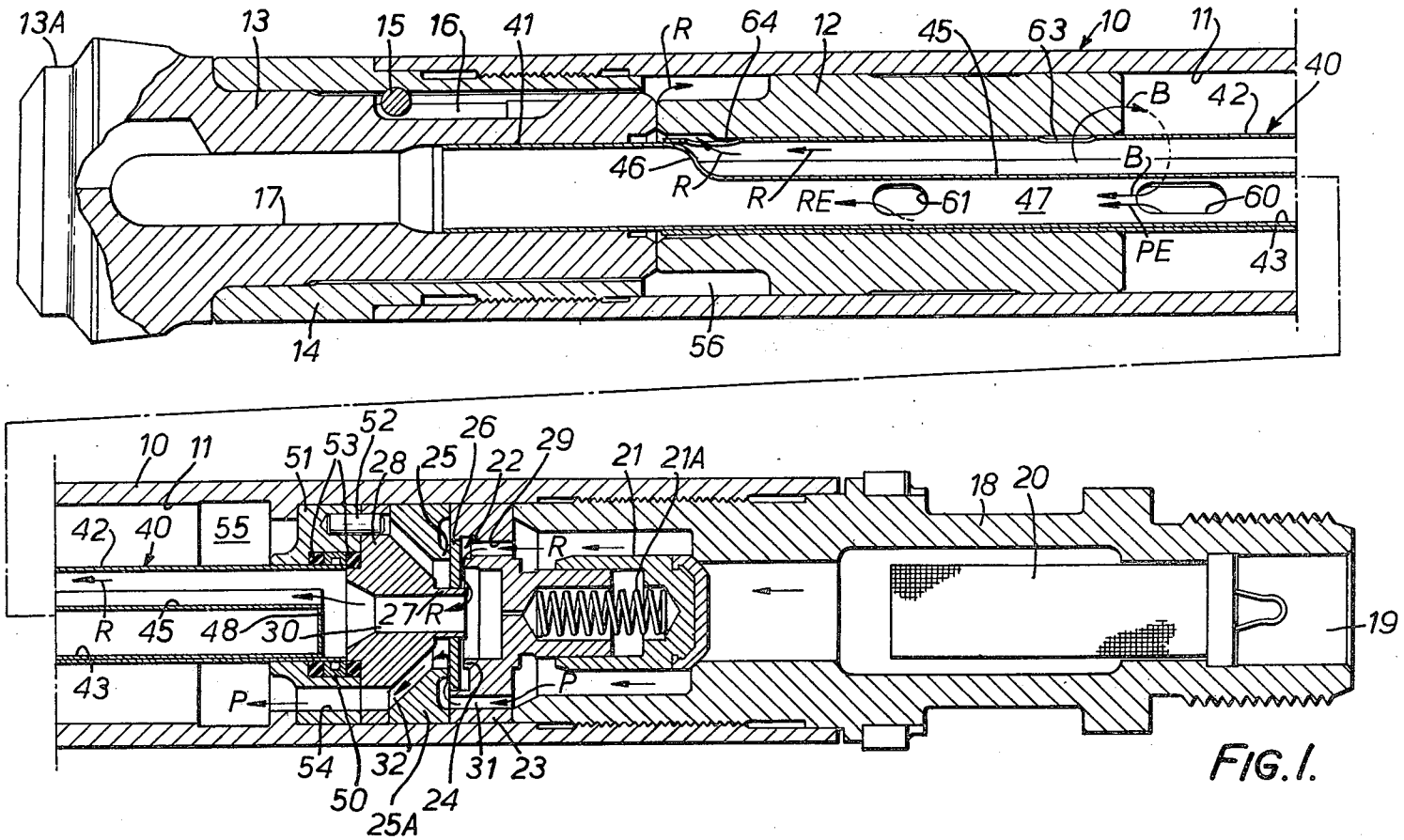
FIG. 1 is a view in longitudinal section of a pneumatic "down-the-hole" drill embodying the present invention.

The "down-the-hole" drill shown in FIG. 1 comprises a tubular drill body 10 having an internal cylinder 11 in which slides a hammer piston 12 for impacting on the upper end of an anvil 13 which is mounted telescopically in a chuck 14 screwed into the lower end of the drill body 10. The anvil is capable of a limited degree of longitudinal sliding movement in the chuck, determined by a retaining pin 15 which engages opposite ends of a longitudinal groove 16 in the anvil 13, and protrudes below the lower end of the drill body where it carries an integral drill bit 13A. An exhaust passage 17 formed as a central bore in the anvil 13 leads through the centre of the bit 13A to the exterior for blowing and flushing purposes.

At its upper end the tubular drill body 10 has a tubular adapter 18 for connection to a feed tube (not shown) through which compressed air is delivered from above ground to the drill. The adapter 18 has a compressed air inlet 19 at its upper end and houses a filter 20 in its bore. A non-return valve 21 with a valve spring 21A allows the passage of the compressed air to a pressure-responsive distribution valve 22 mounted in the upper end of the drill body 10 below the adapter. The distribution valve 22 comprises a fixed valve chest 23 with an upper valve seat 24, a fixed annular lower valve seat 25 on a seat member **25*a*, and a movable valve disc 26 slidably mounted on a central spigot 27 of a fixed plug member 28. In the position illustrated the valve disc 26 is seated against the lower valve seat 25 and allows compressed air from the inlet 19 to flow past the non-return valve 21 through passages 29 in the valve chest 23 and between the disc 26 and the upper valve seat 24 into a central delivery passage 30 in the plug 28, as shown by the arrows R in FIG. 1. When the air pressure below the valve disc 26 lifts it into engagement with the upper valve seat 24, however, the disc closes the passages 29 and allows compressed air from the inlet 19 to flow through passages 31 in the valve chest and between the lower face of the disc 26 and the lower valve seat 25 into an outer delivery passage 32 in the plug 28 as shown by the arrows P in FIG. 1**.

Figure 2A:
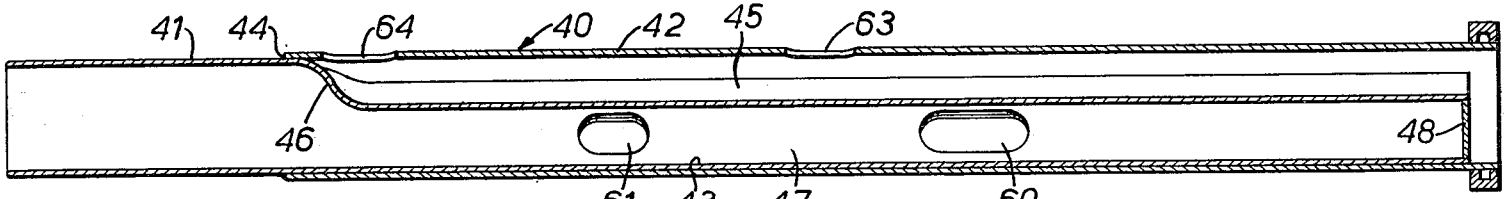
FIGS. 2A and 2B are respectively a longitudinal section and a side view of the central tubular structure of the drill.
Figure 2B:
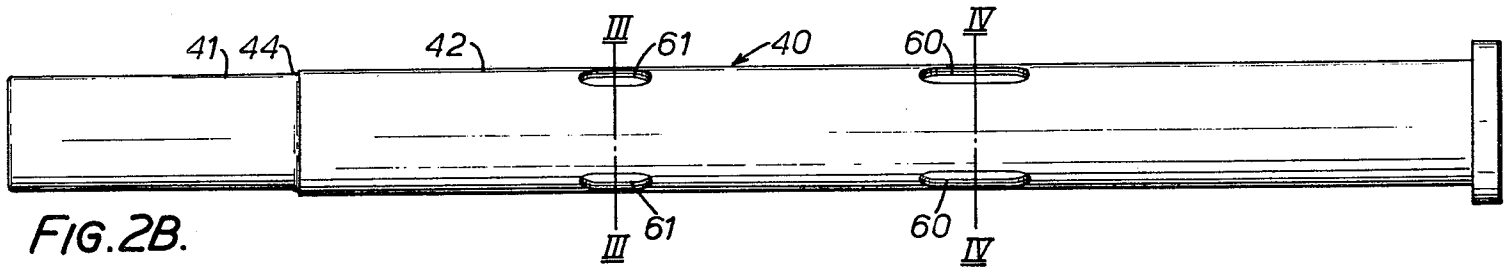
Figure 3:
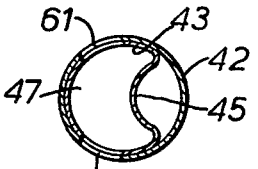
FIGS. 3 and 4 are cross-sections on the lines B—B and C—C of FIG. 2B.
Figure 4:
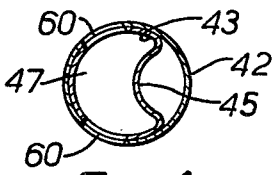

A central ported tubular structure 40 extends longitudinally within the cylinder 11 from the distribution valve to the anvil, and the hammer piston 12 is formed with a central bore and slides on the tubular structure 40. The anvil 13 slides telescopically on the lower end of the tubular structure 40 as shown at 41. The tubular structure 40 comprises a cylindrical outer tube 42, and a longitudinally-indented cylindrical inner tube 43 which is longer then the outer tube in which it is a close fit. The two tubes 42 and 43 are swaged together and brazed at 44 (FIGS. 2A and 2B), and the inner tube 43 is formed with a longitudinal channel-shaped indentation 45 which forms a passage between the walls of the two tubes and is terminated at its lower end at 46. A second passage 47 is formed in the tubular structure 40 by the interior of the inner tube 43, which is closed at its upper end by a welded end wall 48 and at its lower end communicates directly with the exhaust passage 17 in the anvil 13. At its upper end the outer tube 42 is open and carries an external circumferential mounting ring 50 by which it can be secured in the drill body by means of a retainer ring 51 dowelled at 52 to the plug 28. Seals 53 are provided between the mounting ring 50 and the retainer ring 51 and plug 28 respectively. The central delivery passage 30 of the plug 28 opens into the open upper end of the outer tube 42, whilst the outer delivery passage 32 of the plug 28 communicates through a passage 54 in the retainer ring with the upper working chamber 55 outside the tubular structure 40 at the upper end of the main cylinder 11.

Formed in the portions of the walls of the tubes 42 and 43 which are in close contact with one another are two double pairs of registering holes, forming longitudinally-spaced upper and lower exhaust ports 60 and 61 leading respectively from the working chambers 55 and 56 constituted by the upper and lower end portions of the cylinder 11, into the passage 47 through the interior of the inner tube 43.

Formed in the wall of the outer tube 42, in positions communicating with the indentation passage 45, are two longitudinally-spaced ports 63 and 64, which are staggered with respect to the exhaust ports 60, 61. The ports 60, 61, 63 and 64 are all controlled by the hammer piston 12 as it slides up and down the tubular structure 40.

The construction of the tubular structure as described and illustrated, utilising the tubes 42 and 43 positioned one within the other with one of the longitudinal passages formed by an indentation in the wall of the inner tube, and the other passage formed by the interior of the inner tube itself, enables large-area fluid passages to be provided in the tubular structure for a given overall external diameter of the tubular structure, as compared with tubular structures whose passages are separated by machined internal partitions in a main tubular member.

The operation of the drill will now be described, assuming that the drill is introduced into a hole being bored into the ground at the lower end of a drill string or feed tube consisting of a series of feed tube sections joined together end to end. Compressed air is supplied from an above-ground source through the feed tube to the drill, which is rotated together with the feed tube during drilling by means of an above-ground motor acting on the upper end of the feed tube. The necessary downward feed thrust is applied through the feed tube, but the impacting of the drill bit during drilling rotation is effected by means of the reciprocating hammer piston 12 which impacts against the top of the anvil 13 at the end of each downward power stroke of the hammer piston.

Assume that at the start of drilling the drill is initially held suspended by the feed tube in the so-called "blowing" position, with the anvil dropped under gravity to the lowermost position of its travel, i.e. with the retaining pin 15 bearing against the upper end of the groove 16, and with the hammer piston 12 in its lowermost position resting on the chuck 14.

In this position, which is the "blowing" position, the ports 61 and 64 are closed by the piston hammer and the ports 60 and 63 are open to the upper working compartment 55. Compressed air entering through the inlet 19 opens the non-return valve and flows to the distributor valve 22, passing through the passages 29, past the upper side of the valve disc 26 and through the central delivery passage 30 of the plug 28 into the passage 45 in the outer tube 42, to escape through the port 63 into the space around the outer tube 42 and thence through the port 60 into the passage 47 in the inner tube 43, as shown by the arrow B in FIG. 1, from whence it is discharged through the exhaust passage 17 and through the bit 13A to blow the hole surrounding the bit and drill body clear. This flow of blowing air is continuous so long as the drill remains suspended with the anvil hanging in the "blowing" position.

When the drill is fed forwardly to contact the bottom of the hole, by lowering the feed tube, the anvil 13 is lifted together with the piston 12 relatively to the drill body 10, so that the piston first covers the port 63 and then uncovers the port 64. Compressed air then enters the lower working compartment 56 through the passage 45 and port 64, as shown by the arrows R in FIG. 1, to power the upward return stroke of the hammer piston 12. The piston 12 moves upwards until it covers the exhaust ports 60 and uncovers the exhaust ports 61, allowing the compressed air in the lower working chamber 56 to exhaust via the passages 47 and 17 (as shown by the arrow RE in FIG. 1) and the bit centre, the exhaust air emerging at the rock/soil face at the bottom of the hole. This reduces the air pressure on the upper face of the valve disc 26, and the continued upward movement of the piston creates an air cushion in the upper working compartment which arrests the piston at the upper end of its stroke and operates the valve 22, raising the valve disc 26 into contact with the upper seat 24. Delivery air now flows through the non-return valve 21 and the passages 31 and 32 to the outer delivery passages 54 in the retaining ring 51 and thence into the upper working chamber 55, outside the tubular structure 40, as shown by the arrows P in FIG. 1, to power the downward working stroke of the hammer piston 12.

When the downwardly-moving piston 12 uncovers the exhaust ports 60, air in the upper working chamber 55 exhausts through the passages 47 and 17 (as shown by the arrow PE in FIG. 1) and through the bit into the hole being drilled. Downward movement of the piston 12 is arrested by its impact with the anvil 13 which transfers the force of the impact to the bit and to the soil or rock face at the bottom of the hole being drilled. Overrun of the piston 12 and anvil 13 is arrested by the air cushion forming in the lower working chamber 56, directly the port 64 closes, the effectiveness of this air cushion being determined by the piston/cylinder and anvil and chuck relative dimensions and working clearances. The collapse of the air pressure in the upper working chamber when the exhaust ports 60 are uncovered causes the pressure-responsive distribution valve 22 to change back to its original position with the valve disc 26 sealing against the lower valve seating 25, to initiate the next return stroke of the hammer piston.

Thus so long as the downward feed thrust is maintained on the drill, the piston will continue to be reciprocated up and down on the central tubular structure 40 in the cylinder, striking the anvil at the end of each downward stroke, and the exhaust air from the working chambers 55 and 56 will be delivered through the bit into the hole being drilled at the end of each working and return stroke to clear the hole of debris. When the drill feed load is removed and the drill is lifted so that the anvil 13 and bit 13A are allowed to fall down relatively to the drill body 10, the air cushion in the lower working compartment 56 vents via the chuck and the piston is also allowed to fall downwardly, covering the port 64 and uncovering the port 63 to allow uninterrupted blowing of delivery air from the valve 22 via the ports 63 and 60 and the passages 47 and 17 to the bit, as indicated by the arrow B in FIG. 1.

Figure 5:
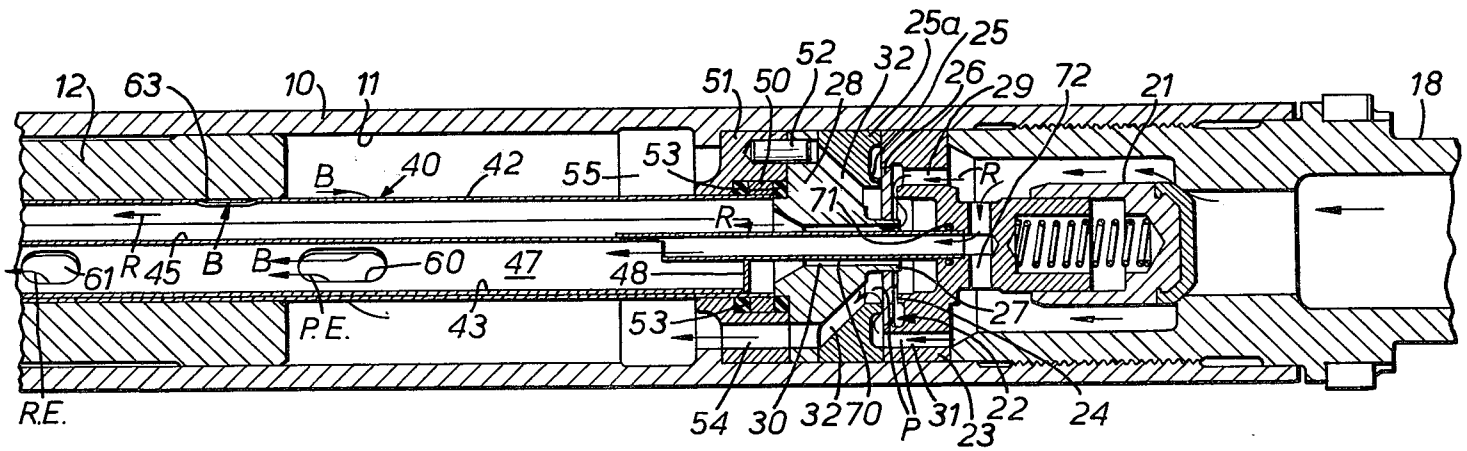
FIGS. 5 and 6 are views similar to FIG. 1 respectively of a first and a second modification thereof.

FIG. 5 shows a modification of the drill of FIGS. 1 to 4, similar parts being given the same reference numerals in the two cases. In the drill of FIG. 5, the inner tube 43 of the tubular structure 40 is provided with an extension 70 leading upwardly from the end wall 48, through the central delivery passage 30, and the centre of the valve chest 23, into a transverse passage 72 which leads into the space between the non-return valve 21 and the distribution valve 22 upstream of the latter. The extension 70 is sealed to the valve chest 23 by a sealing ring 71, and is open at its upper end, and thus provides a continuous flow of blowing air from the inlet 19 through the passage 47 to the exhaust passage 17 and thence out through the bit to clear the hole. Thus hole flushing is not limited to the periods of intermittent exhaust from the working chambers 55 and 56 of the cylinder.

Figure 6:
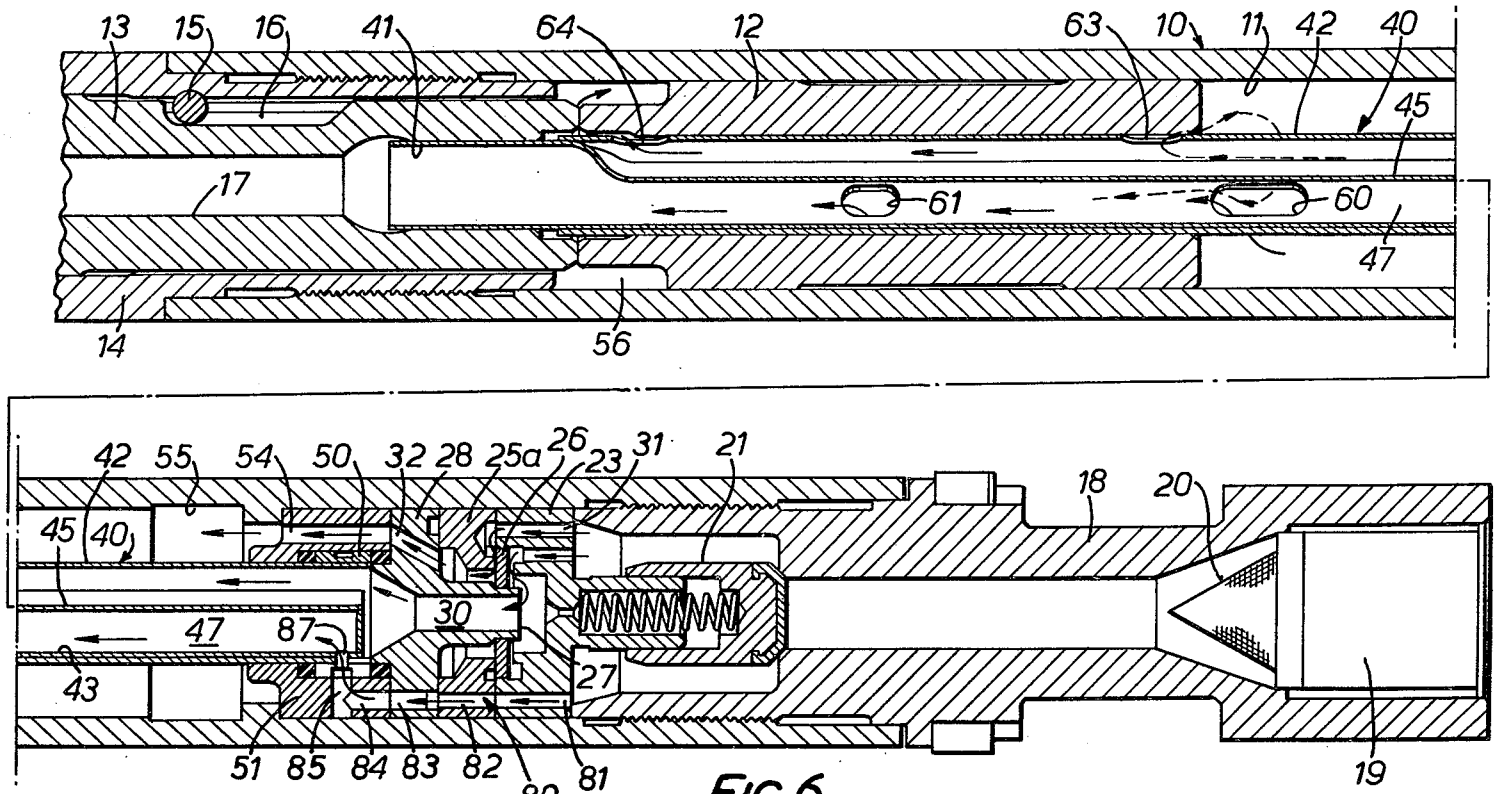

FIG. 6 shows a second modification of the drill of FIGS. 1 to 4 which again provides a continuous flow of blowing air from the inlet to the exhaust passage, to clear the hole being drilled, but in a different manner from that of FIG. 5. Thus in FIG. 6, instead of the extension tube 70 of FIG. 5, there is provided a bypass passage generally indicated at 80 in the valve body which bypasses the distribution valve 22 outside the disc 26 and annular seatings of the latter. Thus the bypass passage 80 comprises aligned longitudinal passages 81, 82, 83 and 84 respectively formed in the members 23, **25*a*, 28 and 51, and a radial passage 85 in the retainer ring 51 which is intersected by the passage 84 and leads inwardly via an aperture in the mounting ring 50 and via aligned holes 87 in the walls of the outer and inner tubes 42 and 43, into the interior of the inner tube 43. Thus the bypass passage 80 will pass a continuous flow of blowing air from the inlet 19, via the filter 20 and non-return valve 21, through the body of the distribution valve 22, bypassing the latter, into the interior of the inner tube 43 along which it will flow straight to the exhaust passage 17 in the anvil 13** and thence to the drill bit, regardless of the position of the anvil or of the condition of the distribution valve.

The modified constructions of FIGS. 5 and 6 are of use in particularly difficult conditions, and it may be necessary to modify the dimensions of the hammer 12 in order to accommodate it to the modified air flow conditions.

What we claim as our invention and desire to secure by Letters is:-

1. A down-the-hole fluid-pressure-operated drill, comprising, a drill body having a fluid inlet on an upper end thereof and having an internal cylinder, a hammer piston reciprocable within said cylinder, upper and lower working chambers at opposite ends of said cylinder, pressure-responsive distribution valve means arranged to deliver pressurized working fluid from said inlet alternately to the upper and lower working chambers for effecting respectively a power stroke and a return stroke of the hammer piston in said cylinder, mounting means for mounting an anvil associated with a drill bit in the lower end of the drill body for impacting said hammer piston against said anvil at the end of each power stroke, an exhaust passage located at the lower end of the drill body for delivery of exhaust fluid from the working chambers to the exterior of the drill body at the lower end thereof for flushing purposes, a tubular structure, having longitudinally spaced parts therein, mounted within the drill body and extending longitudinally through said cylinder and through an axial bore in the hammer piston, said hammer piston being slideable over said tubular structure for cooperating with the longitudinally spaced ports therein, said tubular structure comprising an outer tube and an inner tube extending within the interior of said outer tube, the inner tube being in contact with the outer tube, and said tubular structure having two longitudinal passages extending therethrough to carry working fluid, the longitudinal passages including a first passage which carries pressurized working fluid from the distribution valve means directly into the lower working chamber for effecting the return stroke of the hammer piston, and a second passage which communicates with the exhaust passage and carries exhaust fluid thereto from the upper working chamber at the end of the power stroke and from the lower working chamber at the end of the return stroke, one of said longitudinal passages being defined between the wall of the outer tube and one longitudinal indentation formed in a part of the wall of the inner tube, the remainder of the circumference of said wall part lying against the inner surface of the wall of the outer tube, the indentation at its lower end terminating short of the corresponding end of the inner tube to thereby terminate that end of the respective longitudinal passage, and another of said longitudinal passages being formed by the interior of the inner tube, and portions of the walls of the inner and outer tubes which lie in contact with one another having apertures therein respectively capable of being placed in registry with one another so as to define the ports of the tubular structure.

2. A drill as claimed in claim 1, wherein the distribution valve means is located adjacent an upper end of the tubular structure, and means is provided for passing pressurized working fluid from the distribution valve means directly into the upper working chamber outside the upper end of said tubular structure.

3. A drill as claimed in claim 2, which includes an anvil mounted in said mounting means to slide telescopically in the drill body and on a lower end of the tubular structure, the exhaust passage being formed in the anvil in direct communication with said another longitudinal passage of the tubular structure.

4. A down-the-hole fluid-pressure-operated drill, comprising, a drill body having a fluid inlet on an upper end thereof and having an internal cylinder, a hammer piston reciprocable within said cylinder, upper and lower working chambers at opposite ends of said cylinder, pressure-responsive distribution valve means arranged to deliver pressurized working fluid from said inlet alternately to the upper and lower working chambers for effecting respectively a power stroke and a return stroke of the hammer piston in said cylinder, mounting means for mounting an anvil associated with a drill bit in the lower end of the drill body for impacting said hammer piston against said anvil at the end of each power stroke, an exhaust passage located at the lower end of the drill body for delivery of exhaust fluid from the working chambers to the exterior of the drill body at the lower end thereof for flushing purposes, a tubular structure, having longitudinally spaced parts therein, mounted within the drill body and extending longitudinally through said cylinder and through an axial bore in the hammer piston, said hammer piston being slideable over said tubular structure for cooperating with the longitudinally spaced ports therein, said distribution valve means being of a pressure-responsive disc type housing in the upper end of the drill body and being disposed adjacent an upper end of said tubular structure, means provided for passing pressurized working fluid from said valve means directly into the upper working chamber outside said tubular structure for effecting the power stroke, said tubular structure comprising an outer tube and an inner tube extending within the interior of said outer tube, the inner tube being in contact with the outer tube, and said tubular structure having a plurality of longitudinal passages extending therethrough to carry working fluid, the longitudinal passages including a first passage which carries pressurized working fluid from the distribution valve means directly into the lower working chamber for effecting the return stroke of the hammer piston, and a second passage which communicates with the exhaust passage and carries exhaust fluid thereto from the upper working chamber at the end of the power stroke and from the lower working chamber at the end of the return stroke, one of said longitudinal passages being defined between the wall of the outer tube and a longitudinal indentation formed in a part of the wall of the inner tube, the remainder of the circumference of said wall part lying against the inner surface of the wall of the outer tube, and another of said longitudinal passages being formed by the interior of the inner tube, said tubular structure including an extension of said another passage at its upper end into communication with the pressure fluid inlet, by-passing the distribution valve means, and thus providing an uninterrupted supply of the pressure fluid to the exhaust passage in the vicinity of the drill bit for "supplementary blowing", and portions of the walls of the inner and outer tubes which lie in contact with one another having apertures therein respectively capable of being placed in registry with one another so as to define the ports of the tubular structure.

5. A drill as claimed in claim 4 in which the said extension comprises a bypass passage within the drill body, the bypass passage extending from the interior of the inner tube near its closed upper end and passing outside the valve means into communication with the inlet.

6. A drill as claimed in claim 4 in which the tubular structure includes an extension tube which projects upwardly from the upper end of the inner tube through the centre of the distribution valve means into communication with the fluid flow from said inlet upstream of the distribution valve means, said valve means being located above the tubular structure and being bypassed by said extension tube whereby a continuous flow of the pressure fluid from the inlet to the exhaust passage in the vicinity of the drill bit is provided for "supplementary blowing", which continuous flow is independent of the operation of the distribution valve means.

7. A drill as claimed in claim 6 in which the distribution valve means comprises a pressure-responsive disc valve having an annular movable valve disc with a central aperture through which said extension tube extends.

* * * * *